United States Patent [19]

Cottingham et al.

[11] 4,165,587

[45] Aug. 28, 1979

[54] GRIT BLASTING APPARATUS

[75] Inventors: Richard L. Cottingham, Uckfield; Ralph A. Boyne, Burgess Hill, both of England

[73] Assignee: Thormack Engineering Limited, Uckfield, England

[21] Appl. No.: 847,150

[22] Filed: Oct. 31, 1977

[30] Foreign Application Priority Data

Nov. 2, 1976 [GB] United Kingdom ..... 45564/76

[51] Int. Cl.[2] ..... B24C 3/00

[52] U.S. Cl. ..... 51/428; 51/439

[58] Field of Search ..... 51/439, 428, 429

[56] References Cited

U.S. PATENT DOCUMENTS

| | | | |
|---|---|---|---|
| 2,324,250 | 7/1943 | Voerge | 51/439 |
| 2,669,809 | 2/1954 | McGrath | 51/439 |
| 2,990,653 | 7/1961 | Browning | 51/439 |
| 3,854,997 | 12/1974 | Peck | 51/439 |

*Primary Examiner*—Harold D. Whitehead

*Attorney, Agent, or Firm*—Fleit & Jacobson

[57] ABSTRACT

A method and apparatus for grit blasting in which fuel and air are combusted in a flashback combustion chamber to produce a high velocity gas blasting jet and a stream of grit is introduced into the blasting jet.

5 Claims, 2 Drawing Figures

GRIT BLASTING APPARATUS

Figure 1:
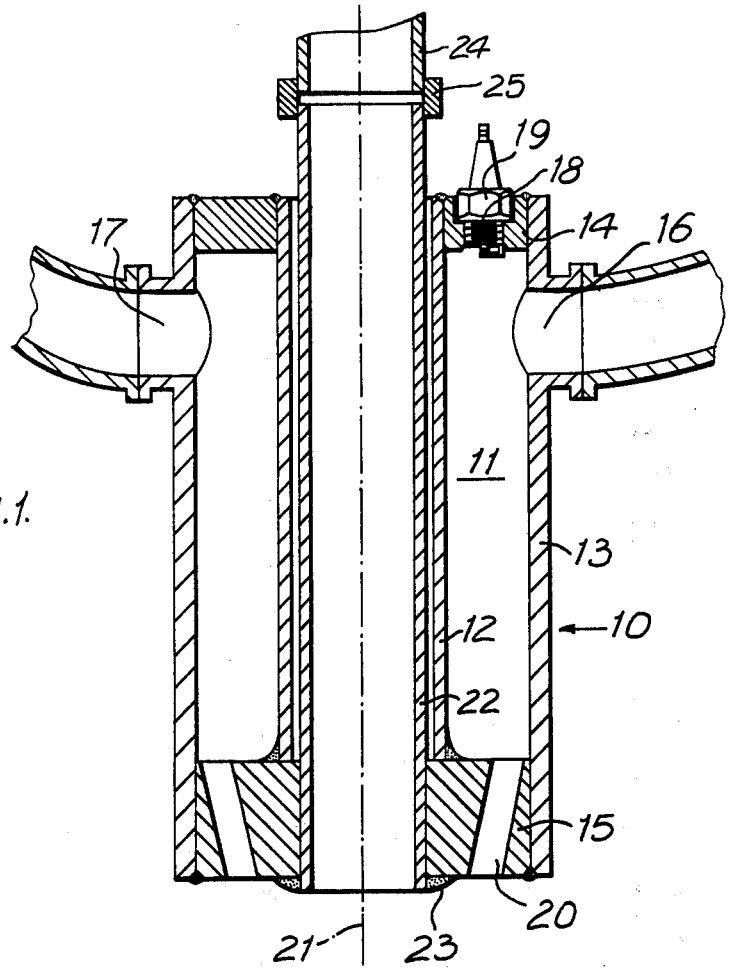

The present invention relates to an apparatus for, and method of grit blasting. In methods of grit blasting already in widespread use, grit such as sand is introduced into a jet of high velocity working fluid, the working fluid usually being water as this gives a more effective blasting action than if the working fluid is gaseous. Grit blasting can be used for a variety of different purposes for example, cleaning masonry and cleaning rust and old paint off iron or steel structures such as, for example, bridges in preparation for painting. The grit in the jet tends to abrade and loosen material while the working fluid itself causes loosened material to be carried away from the zone which is being treated.

According to the present invention we now provide apparatus for grit blasting comprising the steps of combusting a fuel/air mixture, to provide a high velocity hot gas blasting jet, and introducing into the blasting jet a stream of grit particles.

We have found that a combination of the hot working gas and grit gives a much greater increase in effectiveness than it would be reasonable to expect from simply combining a hot working fluid with a grit stream. Indeed, apart from its quite surprising effectiveness, the device has a number of advantages in applications such as preparing iron or steel structures such as bridges for painting or similar treatment. Thus in, for example, the application of the device to the process of preparing a bridge for repainting, the blasting jet is extremely effective in removing old paint and rust leaving a surface ready for painting and it also has the advantage that unlike those prior methods which use water as the working fluid, the metalwork is left dry as soon as the blasting is complete. Also, the metalwork is left in a warm condition which facilitates the use of epoxy-based paints. Apart from being more effective in preparing the metalwork surface that prior methods which use water as the working medium, this method also avoids another problem which is encountered when using water as the working medium, namely that of new rust forming as the water left on the metalwork after blasting evaporates.

We provide a grit blasting apparatus comprising a burner assembly including a combustion chamber, at least one inlet for fuel and air to said combustion chamber, an outlet of said combustion chamber for a blasting jet of combustion gases and a feed pipeline for feeding a stream of grit into said blasting chamber for entrainment thereby. Preferably the combustion chamber is a flash-back condition combustion chamber, in which combustion is complete within the combustion chamber.

In a preferred embodiment of the invention, the combustion chamber is annular, comprising an outer tubular wall, an inner tubular wall, a first annular end plate connected to said outer and inner tubular wall, an igniter on said first end plate, a second annular end plate connected to said outer and inner walls, at least one inlet for fuel and air to the space formed between the outer and inner tubular walls, at least one jet forming aperture in said second end wall, and a feed pipeline for feeding a stream of grit into said jet for entrainment thereby.

The inner and outer tubular walls and a first and second annular end plate are to be made of a material suitable to withstand the temperature, typically 1,760° C. which occurs during combustion of the material. A suitable material is the nickle, chromium, iron and titanium alloy sold under the name ICONEL 600.

The feed pipelines for the grit preferably passes through the inner tubular wall and is radially spaced therefrom, so that it is not directly subjected to the high temperature within the combustion chamber. This pipeline is advantageously made of mild steel which is case hardened on the interior surface to prevent abrasion by the sand or other grit.

Figure 2:
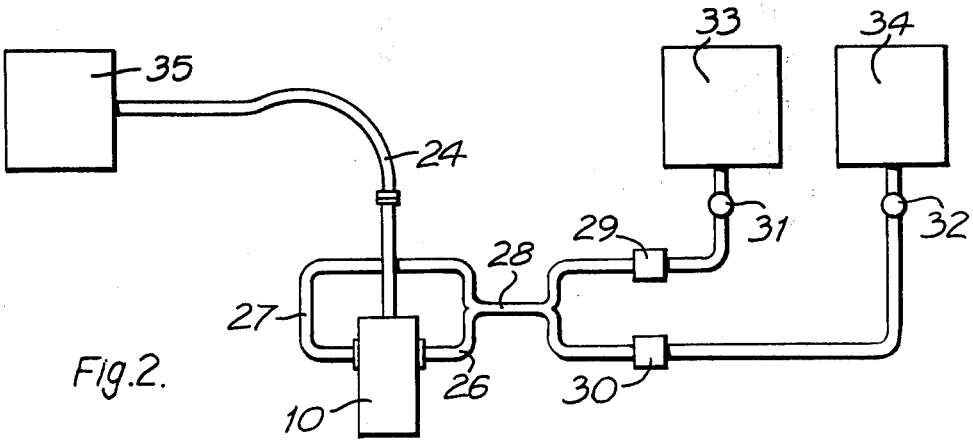

In order that the present invention may more readily be understood, the following description is given, merely by way of example, reference being made to the accompanying drawings, in which:

FIG. 1 is a somewhat schematic cross-section through one embodiment of burner assembly of an apparatus according to the invention; and FIG. 2 is a grit-blasting apparatus incorporating the burner assembly of FIG. 1.

The burner assembly 10 shown in FIG. 1 comprises an annular combustion chamber 11 defined by an inner tubular wall 12 and an outer tubular wall 13 as well as by a first annular end wall 14 and a second annular end wall 15.

At diametrically opposite locations, the outer tubular wall 13 is provided with inlet ports 16 and 17, whilst the first end wall 14 is provided with a threaded aperture 18 for accommodating a spark plug 19.

The second end wall 15 has a plurality, for example 6, equally circumferentially spaced nozzle forming apertures 20 which are inclined to the axis 21 of the burner assembly at an angle of approximately 10° to 15° and in a preferred construction according to the invention at an angle of 11⅛.

Extending axially within the inner annular wall 12 is a sand supply tube 22 which is welded with an annular weld 23 to the end wall 15 and extends upwardly in spaced relation to the inner wall 12. A sand supply conduit 24 is connected thereto by a pipe fitting 25.

The parts 12, 13, 14 and 15 of the burner assembly should be made of a material which can withstand high temperature and a preferred material is an alloy of metal, chromium, iron and plutanium sold under the name "INCONEL 600", suitable to withstand the temperature of the fuel/air mixture which burns therein. The pipe 22, on the other hand, is advantageously made of mild steel with its case hardened on its inner surface to withstand the abrasive effect of the sand. The members 12, 13, and 15 are connected together, for example, by means of a tungsten inert gas (TIG) weld. The upper end plate 14 can be connected in any suitable manner e.g. by means of a securing cap (not shown).

The connection illustrated in FIG. 2 involves a fuel air mixture supply line 28 which is divided to form two sub-lines 26 and 27 connected respectively to the posts 16 and 17 by suitable couplings.

Pressurised fuel, preferably propane gas at 1.76 kilogrammes per sq. cm gauge pressure from a tank 34 and air at 3.52 kilogrammes per sq. cm gauge from a compressor 33 are delivered via respective pressure regulators 32 and 31 and metering valves 30 and 29 to the mixer conduit 28 before being fed to the combustion chamber 11.

The conduit 24 is connected to a pressurised supply 35 of sand, or other grit, and air.

In use, the fuel/air mixture is completely burned in a flash-back condition within the combustion chamber and the hot gases thus produced issue from the nozzles 20 at a high temperature and velocity. Typically the temperature of the hot gases will be approximately 1,760° C. within the chamber and 1,650° C. on exit therefrom and the gases will issue from the nozzle at a velocity of approximately 900 meters per second. Since combustion is completed within the chamber the flame is contained in the chamber and protected from adverse environmental conditions. During start up, the mixture within the chamber is ignited by temporarily connecting the spark plug 19 to a suitable portable source of high voltage, such as a battery operated vibrator.

Once the combustion chamber is heated up and stable combustion has been achieved, the delivery of the sand by the conduit 24 can be commenced. The sand can be delivered positively by means of a screw or vane conveyor or by using compressed air as a carrier fluid. As an alternative to positive delivery of the sand, it can be sucked through the tube 22 by virtue of the low pressure existing within the central region of the jet of hot gases issuing from the nozzles 20. In some arrangements the sand can be gravity fed to the burner assembly. Sand passing down the tube 22 is preheated slightly due to the radiant heat 12 from the inner wall of the combustion chamber heating the tube 22.

The sand exiting from the lower end of the tube 22 is mixed with a jet of hot gases from the combustion chamber to form a combined jet of high velocity hot gases and hot sand. This combined jet can then be directed at a surface which requires treatment such as abrasion or cleaning. The apparatus has been found to be particularly effective for removing rust and old paintwork from iron and steel structures which are being prepared for repainting. One advantage of carrying out the preparation for painting in this way is that the metal work is left dry and warm, the latter being an important factor when the metal work is to be repainted using epoxy based paints.

We claim:

1. A grit blasting apparatus comprising, in combination:

(a) a burner assembly including an annular combustion chamber comprising:
- (i) an outer tubular wall;
- (ii) an inner tubular wall;
- (iii) a first annular end plate connected to said outer and inner tubular walls;
- (iv) an igniter on said first end plate;
- (v) a second annular end plate connected to said outer and inner walls;
- (vi) at least one inlet for fuel and air to the space formed between the outer and inner tubular walls;
- (vii) means defining an annular jet in said second end wall, whereby combustion in said combustion chamber takes place in a flashback condition in which the combustion is complete within the combustion chamber and an annular blasting jet of combustion gases leaves said combustion chamber via said jet;

(b) a feed pipeline extending through said inner tubular wall for feeding a stream of grit into the interior of said jet for entrainment thereby.

2. Apparatus according to claim 1, wherein said feed pipeline comprises a pipeline passing through and radially spaced from, said inner tubular wall.

3. Apparatus according to claim 1, wherein two inlets for fuel and air are provided, at diametrically opposed locations in opposite sides of said outer tubular wall.

4. Apparatus as claimed in claim 1, wherein said second end plate comprises a plurality of jet forming apertures arranged in an annular array and inclined inwardly towards the axis of said combustion chamber.

5. Apparatus as claimed in claim 1, wherein said igniter comprises a spark plug arranged in said second annular wall.

* * * * *